US005616038A

United States Patent [19]

Okamoto et al.

[11] Patent Number: 5,616,038

[45] Date of Patent: Apr. 1, 1997

[54] CONNECTOR-COUPLING-LEVER MOUNTING METHOD AND ASSEMBLY THEREOF

[75] Inventors: Kenichi Okamoto; Naoto Taguchi, both of Haibara-gun, Japan

[73] Assignee: Yazaki Corporation, Tokyo, Japan

[21] Appl. No.: 523,247

[22] Filed: Sep. 5, 1995

[30] Foreign Application Priority Data

Sep. 6, 1994 [JP] Japan ..... 6-212600

[51] Int. Cl.[6] ..... H01R 13/62

[52] U.S. Cl. ..... 439/157

[58] Field of Search ..... 439/152–160, 439/372

[56] References Cited

U.S. PATENT DOCUMENTS

| | | | |
|---|---|---|---|
| 5,139,430 | 8/1992 | Lewis et al. | 439/160 |
| 5,330,362 | 7/1994 | Ho et al. | 439/157 |
| 5,344,194 | 9/1994 | Hatagishi | 439/157 |
| 5,373,419 | 12/1994 | Wright | 439/157 |
| 5,414,594 | 5/1995 | Hristake | 439/155 |
| 5,476,391 | 12/1995 | Katsuma | 439/157 |
| 5,482,394 | 1/1996 | Shunchi et al. | 439/157 |
| 5,484,297 | 1/1996 | Takahashi et al. | 439/157 |

FOREIGN PATENT DOCUMENTS 4-87169 3/1992 Japan .

*Primary Examiner*—P. Austin Bradley
*Assistant Examiner*—Jill Demello
*Attorney, Agent, or Firm*—Armstrong, Westerman, Hattori, McLeland & Naughton

[57] ABSTRACT

A connector-coupling lever is mounted to the corresponding connector housing according to the following steps. The windings of a spring engage with a supporting shaft extending from a side wall of a connector housing, and one end of the spring is fixed to a locking portion of the side wall. The other end of the spring engages with a provisional locking channel by way of an insertion channel, wherein both the insertion channel elongated along the side wall of the connector housing and the provisional locking channel extending in the direction away from the side wall are provided in a provisional locking portion attached to the connector housing. A bearing hole formed in a side arm of the connector-coupling lever engages with the supporting shaft. The other end of the spring is pushed toward the side wall by the side arm of the lever so that the resilient force of the spring can release the other end of the spring from the provisional locking channel so as to fit the other end in a spring-end receiving portion formed in the side arm of the lever.

6 Claims, 7 Drawing Sheets

CONNECTOR-COUPLING-LEVER MOUNTING METHOD AND ASSEMBLY THEREOF

BACKGROUND OF THE INVENTION

1. Field of the Invention

The present invention relates to a couple of connectors with a connector-coupling lever, more particularly to a method and an assembly for easily mounting a connector-coupling lever in the connector housing.

2. Description of the Prior Art

Referring to FIG. 8, a female connector housing D has a rotation shaft 25, and a guiding cut-out portion 26 for guiding a corresponding male connector (not shown). One side of the connector housing D has a supporting shaft 28 for a spring, a provisionally locking protrusion 29 for the spring, a spring receiving channel 30 in a substantially circular arc shape, a lower supporting portion 30*a* and an upper supporting portion 31 that are provided upward from the spring receiving channel 30, and a recess 32 for receiving the spring E.

The spring E, as shown in FIG. 8, has spring windings 34 in the middle, a resilient portion 35*a* corresponding to a connector-coupling lever at one end, and a resilient portion 36*a* corresponding to the connector housing at the other end. Further, each tip of the both resilient portions respectively has a locking end 35*b* corresponding to the connector-coupling lever or a locking end 36*b* corresponding to the connector housing.

The connector-coupling lever F, as shown in FIGS. 9 and 10, has each of side arms 38, 38' at each side of the lever. Each of the side arms 38, 38' has a shaft bearing hole 39 and a cam guiding channel 40. The cam guiding channel 40 pulls the male connector housing along the guiding cut-out portion 26 in accordance with the turn of the lever F. The left side arm 38 has, inside of it, a guide channel 41 by which the resilient portion 35*a* can easily move in accordance with the expansion or the contraction of the spring E, and a protection wall 42 that prevents the resilient portion 35*a* from falling off out of the guide channel 41. The guide channel 41 has a locking protrusion 43 corresponding to the locking end 35*b*. Further, a protrusion 44 for releasing a provisional locking of the spring E is provided so as to extend from and to locate in the middle of the protection wall 42.

The connector-coupling lever F is mounted, with the spring E, in the housing D in accordance with the following process.

At first, as shown in FIG. 8, the locking end 36*b* is inserted into the recess 32; the resilient portion 36*a* is positioned between the upper supporting portion 31 and the lower supporting portion 30*a*; and the spring windings 34 engages with a supporting shaft 28 so that the periphery of the spring windings 34 is positioned along the spring receiving channel 30. At this initial step, the locking end 35*b* of the resilient portion 35*a* is yet not locked.

Next, the locking end 35*b* engages with the provisionally locking protrusion 29 by the resilient force of the spring E against an added external force. In this step, the resilient portion 36*a* and the locking end 36*b* have kept the same state as the previous step.

Then, as shown in FIG. 9, as keeping the state that the locking end 35*b* engages with the provisionally locking protrusion 29, the shaft bearing hole 39 in the left side arm 38' engages with the turn shaft 28 of the housing D; then, the shaft bearing hole 39 in the right side arm 38 engages with a turn shaft 28; and the coupling lever is positioned to be upright. In this step, the coupling lever F has not yet received the resilient force of the spring E, because the locking end 35*b* has engaged with the provisionally locking protrusion 29.

At last, the coupling lever F turns from the upright position to the substantially horizontal position in the direction of the arrow P shown in FIG. 9, by providing an external force. Thereby, a releasing end 44*a* in the protrusion 44 for releasing a provisional locking of the spring E pushes the resilient portion 35*a* to raise it upward. Consequently, the locking end 35*b* is released from the provisionally locking protrusion 29 for the spring by the resilient force of the spring E. At the same time, the resilient portion 35*a* abuts the guide channel 41 and the locking end 35*b* engages with a locking protrusion 43 for the spring.

However, in the above-mentioned conventional mounting method and assembly thereof, when the spring engaged with the provisionally locking protrusion is released to engage with the coupling lever, the coupling lever attached to the turning shaft must be moved backward by providing with an external forced on the coupling lever. Therefore, it has needed an additional time and further works that the coupling lever is mounted in the connector housing with a spring.

SUMMARY OF THE INVENTION

In view of the above-mentioned disadvantage, the object of the present invention is to provide a method and an assembly for easily mounting a connector-coupling lever with a resilient spring in the connector housing without turning the coupling lever.

To accomplish the above-mentioned object, a connector-coupling-lever mounting method according to the present invention includes the steps of: engaging the windings of a spring with a supporting shaft extending from a side wall of a connector housing, and fixing one end of the spring to a locking portion of the side wall; engaging the other end of the spring with a provisionally locking channel by way of an insertion channel, wherein both of the insertion channel along the side wall of the connector housing and the provisionally locking channel extending in the direction away from the side wall are provided in a provisionally locking portion attached to the connector housing; engaging a bearing hole formed in a side arm of the connector-coupling lever with the supporting shaft; and pushing the other end of the spring toward the side wall by the side arm of the lever so that the resilient force of the spring can release the other end of the spring from the provisionally locking channel so as to fit the other end in a spring-end receiving portion formed in the side arm of the lever.

Further, the connector-coupling-lever mounting method may include the steps of: engaging one of the side arms, which has the spring-end receiving portion, of the lever with one of the side walls, which has the provisionally locking portion, of the connector housing; and then, engaging the other side arm of the lever with the other side wall of the connector housing.

Moreover, a connector-coupling-lever mounting assembly according to the present invention includes: a connector-coupling lever; a connector housing having a side wall with a supporting shaft extending from the side wall, wherein the supporting shaft engages with a bearing hole formed in a side arm of the connector-coupling lever; a spring providing with a resilient force to the connector-coupling lever, wherein the spring has windings engaging with the supporting shaft; a locking portion fixing one end of the spring and a provisionally locking portion engaging the other end of the spring, which are provided on the side wall of the connector housing; and a lever-engagement guiding portion attached to the connector housing so as to extend to the outside of the side wall of the connector housing, wherein the engagement guiding portion connects to the provisionally locking portion that has both of an insertion channel along the side wall of the connector housing and a provisionally locking channel extending from the insertion channel in the direction away from the side wall.

In operation of the above-mentioned connector-coupling-lever mounting assembly, the windings of the spring engage with the supporting shaft of the connector housing; one end of the spring is fixed to the locking portion; and the other end of the spring is engaged with the provisionally locking portion against the resilient spring force. When the coupling lever engages with the connector housing and the shaft bearing hole engages with the supporting shaft, the inner side face of the side arm of the connector-coupling lever pushes the other end of the spring toward the side wall of the connector housing. Thereby, the other end of the spring is released from the provisionally locking portion so that the resilient force of the spring may turn the other end of the spring so as to fit it in a spring-end receiving portion formed in the side connection plate of the lever.

DETAILED DESCRIPTION OF THE PREFERRED EMBODIMENTS

Figure 1:
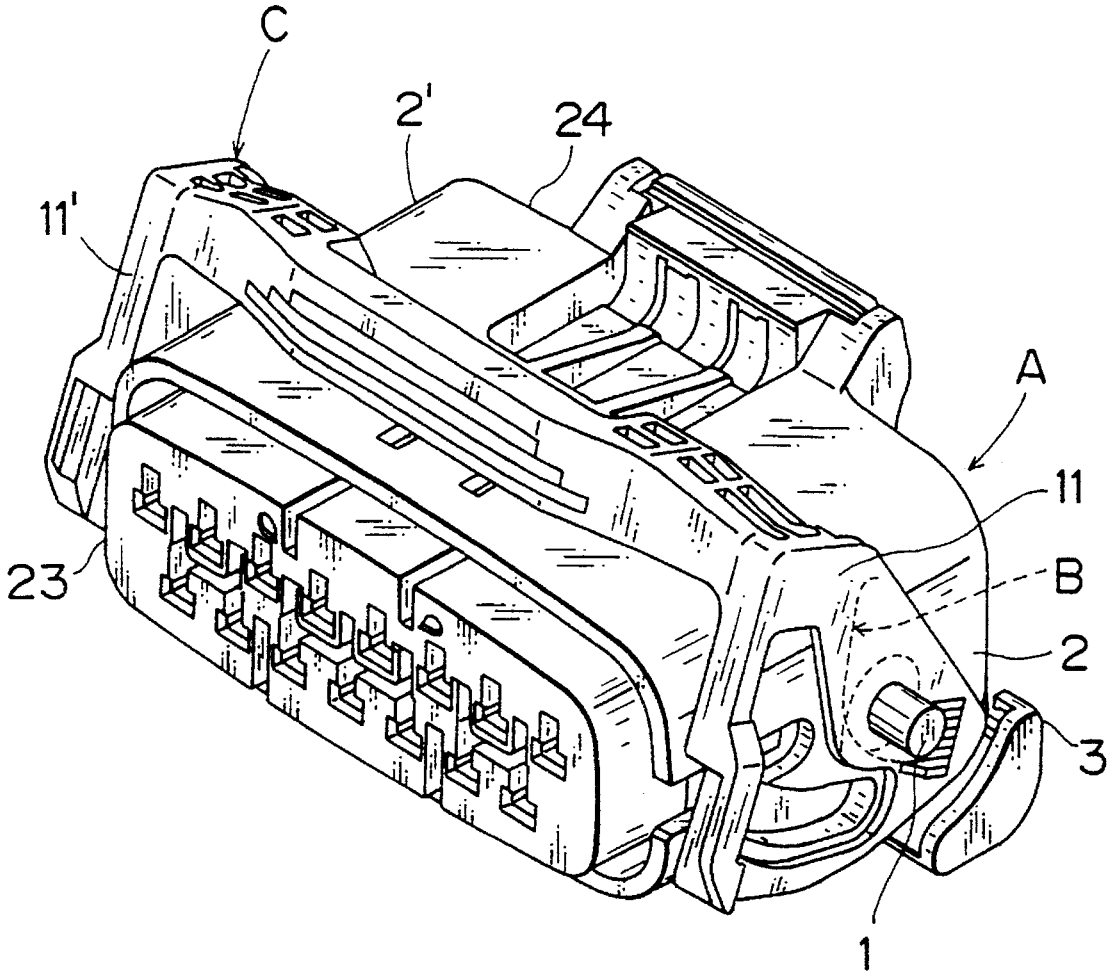
FIG. 1 is a perspective view of an embodiment of connector-coupling-lever mounting assemblies according to the present invention.

In FIG. 1, both of a female connector housing A and a coupling lever C are made of synthetic resins. The housing A is composed of a front coupling compartment 23 for a male connector housing (not shown) and a rear accommodating compartment 24 for terminals (not shown). And, on the both sides of the housing A, an outward extending supporting shaft 1 is provided, the shaft engaging with both of a spring B and the coupling lever C. Along the periphery of a side wall 2 of the housing A, an engagement guide 3 is provided so as to outward extend over the side wall 2. Further, the engagement guide 3 is located in the lower, right side of the supporting shaft 1.

Figure 2:
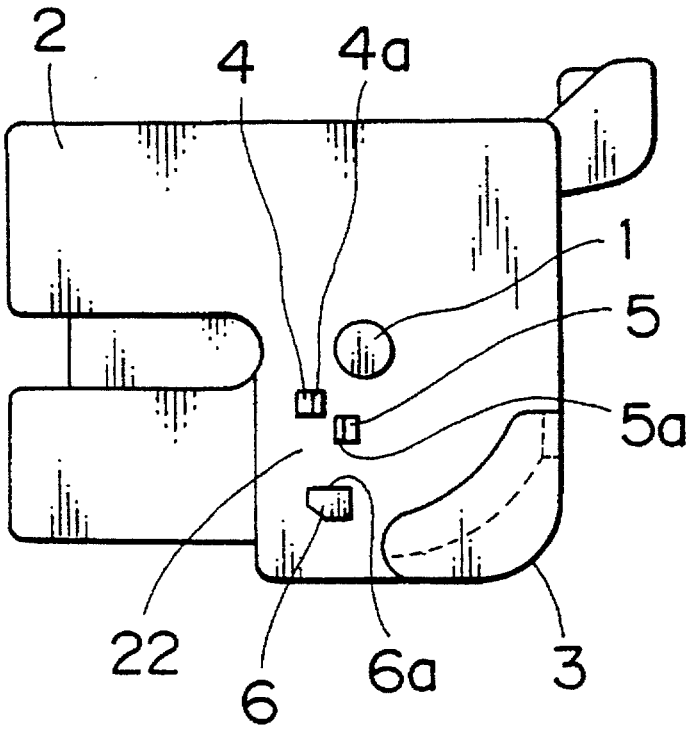
FIG. 2 is a side view of the connector housing in the embodiment.

Moreover, as shown in FIG. 2, the side wall 2 of the housing has a locking portion 22 for locking a spring that provides a resilient force to the coupling lever C. The locking portion 22 is composed of an upper protrusion 4, a lower protrusion 5, and a projecting piece 6 for fixing a spring end, which are located below the supporting shaft 1. And, the upper protrusion 4 has a supporting end **4*a* in rear; the lower protrusion 5 has a supporting end 5*a* in front; and, the projecting piece 6 for fixing a spring end has a locking channel 6*a*** for locking the spring B.

Figure 3A:
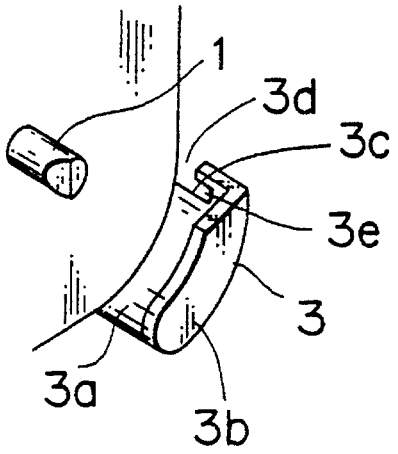
FIG. 3A is a perspective view of the primary parts of the provisionally locking portion in the embodiment.
Figure 3B:
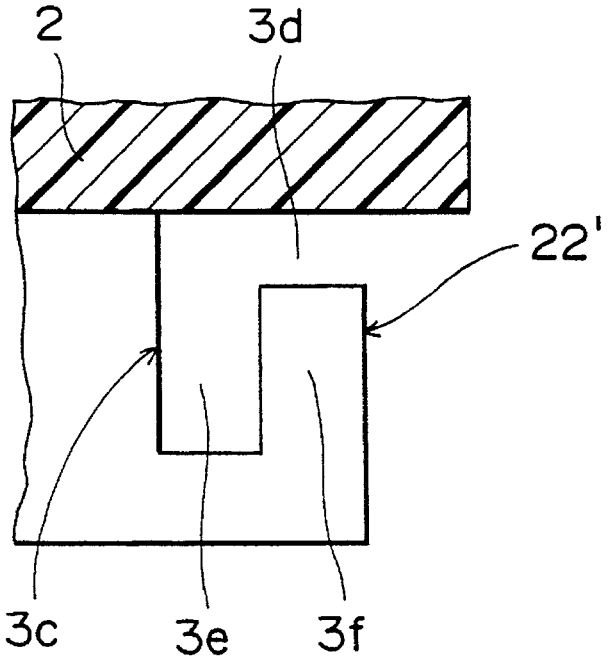
FIG. 3B is a sectional view of a primary part of the provisionally locking portion.

As shown in FIG. 3, the engagement guide 3 has a guiding channel wall **3*a* extending vertically to the side wall 2 of the housing, and a fall-out-preventing wall 3*b* parallel to the side wall 2 of the housing. The guiding channel wall 3*a* has a shape of an arc with a center at the supporting shaft 1. The fall-out-preventing wall 3*b* prevents the coupling lever C engaged with the housing A from the housing wall 2. Further, in the rear of the guiding channel wall 3*a*, a provisionally locking cut-out portion 3*c* for the spring is provided as a provisionally locking portion 22' that has a shape of the letter L. That is, the provisionally locking cut-out portion 3*c* for the spring is composed of a spring insertion channel 3*d* parallel to the housing side wall and a provisionally locking channel 3*e* perpendicular to the housing wall. Further, the provisionally locking channel 3*e* has a hooking protrusion 3*f***.

Figure 4:
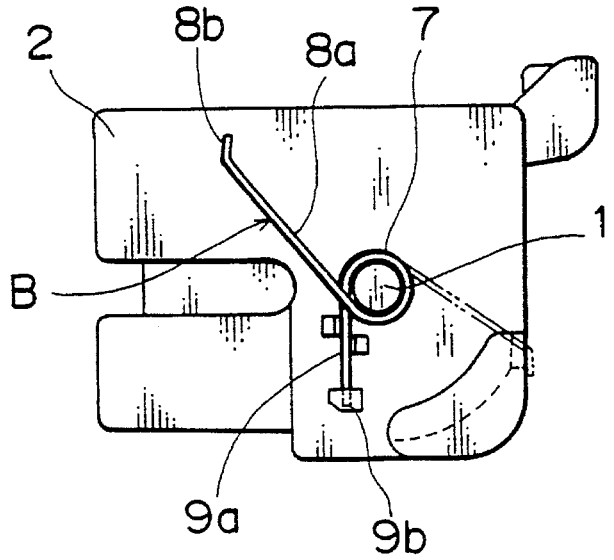
FIG. 4 is a side view of the connector housing with a spring mounted state in the embodiment.

As shown in FIG. 4, the spring B has windings 7 providing with a resilient force; the longer resilient portion **8*a* that is extending forward to the windings 7 and will be set in the coupling lever; the shorter resilient portion 9*a* that is extending afterward to the windings 7 and will be set in the connector housing; a locking end 8*b* at the tip of the longer resilient portion 8*a*, being bent inward; and, a locking end 9*b* at the tip of the shorter resilient portion 9*a***.

Figure 5:
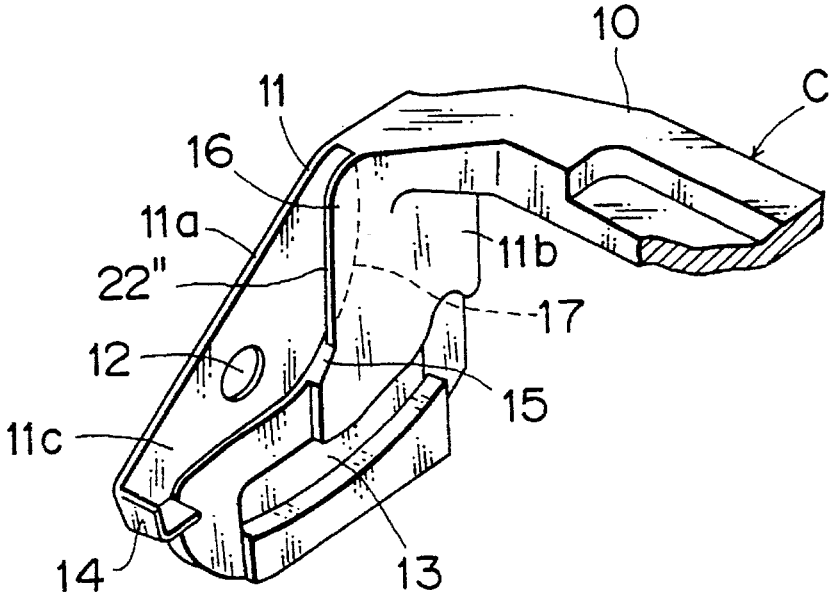
FIG. 5 is a perspective view of the primary parts of the coupling lever in the embodiment.

As shown in FIG. 5, the coupling lever C is composed of an operating plate 10 and side arms 11, 11' attached at the both ends of the operating plate 10. The each of the side arms 11, 11' has a shaft bearing hole 12 corresponding to the supporting shaft 1 of the connector housing A; a cam guiding channel 13 for guiding a male connector housing (not shown); and a projecting piece 14 corresponding to the engagement guide 3. The side arms 11 is composed of a thinner plate portion **11*a* and a little thicker plate portion 11*b*. And, inside of the side arms 11, there is a step 15 between the thinner plate portion 11*a* and the thicker plate portion 11*b* so that a cut-out portion 11*c* is formed inside the thinner plate portion 11*a***.

And, when the projecting piece 14 extending inward from the side arms 11, 11' proceeds into the guiding channel wall **3*a*, the projecting piece 14 prevents the coupling lever C from falling out of the housing A. Further, a spring-end receiving portion 22" is provided in the right side arm 11 corresponding to the side wall portion of the connector housing A. The spring-end receiving portion 22" includes an a protecting wall 16 provided inside from the right side arm 11. The protecting wall 16 prevents the spring B from falling out of the coupling lever C, when the coupling lever C is turned backward after the housing A has engaged with the side arm 11 in conjunction with the spring B between them. Also, an engagement channel 17 corresponding to the longer resilient portion 8*a* sis provided between the protecting wall 16*a* and the thinner plate portion 11*a***.

The process of mounting the coupling lever C with the spring B to the housing A will be explained in the followings.

First, as shown in FIG. 4, the windings 7 of the spring B engage with the supporting shaft 1 of the connector housing A. And, the locking end **9*b* of the spring B proceeds into the locking channel 6*a* inside the projecting piece 6 for fixing the spring end. Then, the shorter resilient portion 9*a* is inserted between the upper supporting end 4*a* and the lower supporting end 5*a*. At that time, the spring B yet does not provide with a resilient force, because the longer resilient portion 8*a* and the locking end 8*b*** are free at this initial step.

Next, as keeping the previous state in regard to the shorter resilient portion 9*a* and the locking end 9*b*, as shown in FIG. 4, the locking end 8*b* is introduced sequentially into the spring-end insertion channel 3*d* and the spring-end provisionally locking channel 3*e* so as to engage with the hooking protrusion 3*f*. At that time, it is carried out as providing an external force to the longer resilient portion 8*a* against the resilient force of the spring B. In the state that the locking end 8*b* engages with the hooking protrusion 3*f*, the locking end 8*b* is completely apart from the housing side wall 2.

Figure 6:
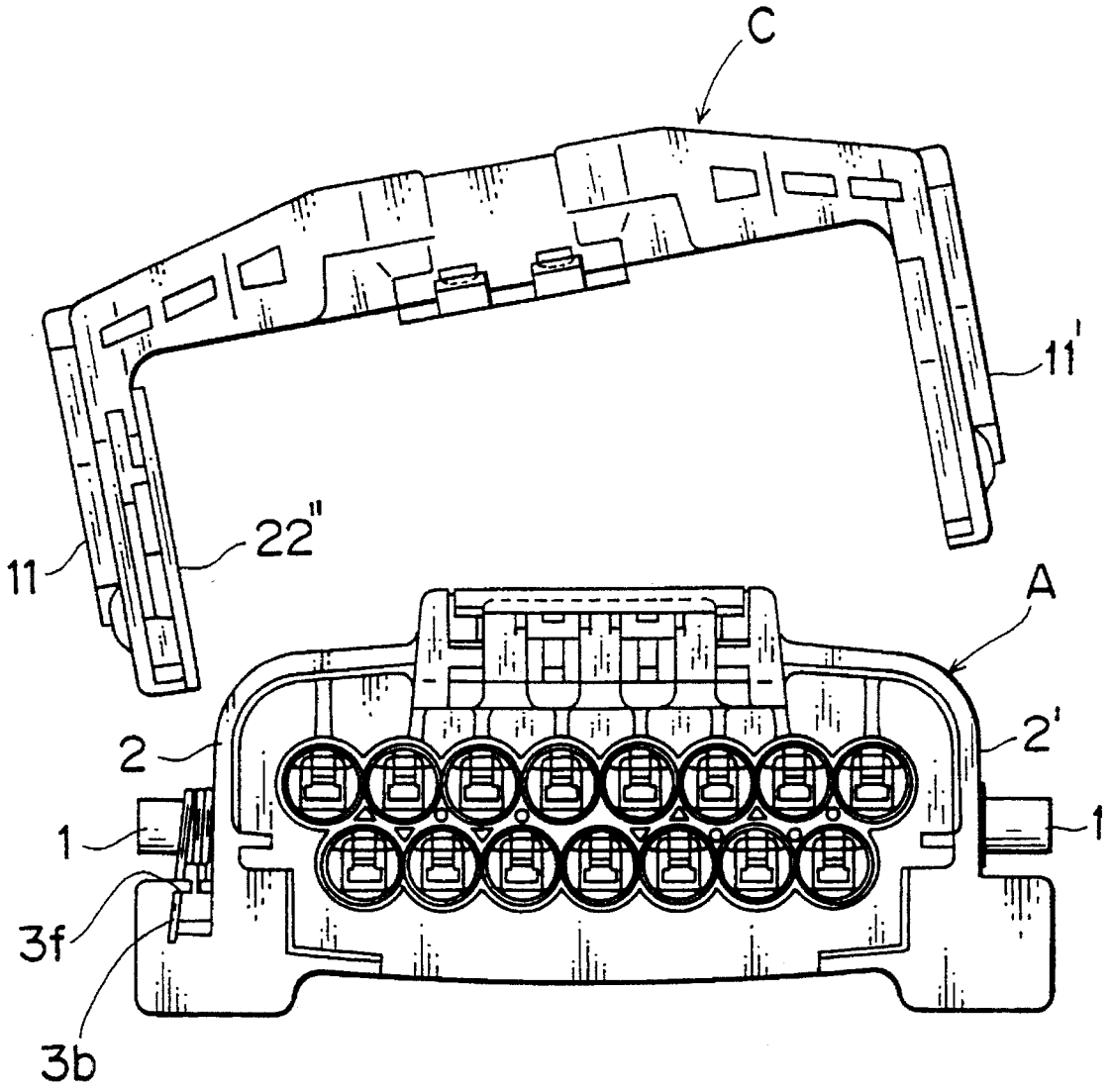
FIG. 6 is a rear elevation showing a step of mounting the coupling lever to the connector housing in the embodiment.

Finally, as shown in FIG. 6, as keeping the state that the locking end 8*b* of the spring B engages with the hooking protrusion 3*f*, the coupling lever C is mounted to the connector housing, first to the side with the spring-end receiving portion 22" such that the coupling lever C will have been turned backward.

In that mounting process, when the shaft bearing hole 12 is gradually engaged with the supporting shaft 1 of the connector A, the inner side of the thinner plate portion 11*a* in the side arm 11 of the coupling lever C initially abuts to the longer resilient portion 8*a*. And, when the shaft bearing hole 12 further proceeds along the supporting shaft 1, the thinner plate portion 11*a* pushes the longer resilient portion 8*a* toward the housing side wall 2 (in the arrow direction P in FIG. 7). Thereby, the locking end 8*b* passes the provisionally locking channel 3*e*, and it is released from the hooking protrusion 3*f* to enter into the spring-end insertion channel 3*d*. Consequently, the longer resilient portion 8*a* turns back along the thinner plate portion 11*a* by the resilient force of the spring B so that the longer resilient portion 8*a* is received into the channel between the thinner plate portion 11*a* and the protecting wall 16.

Figure 7:
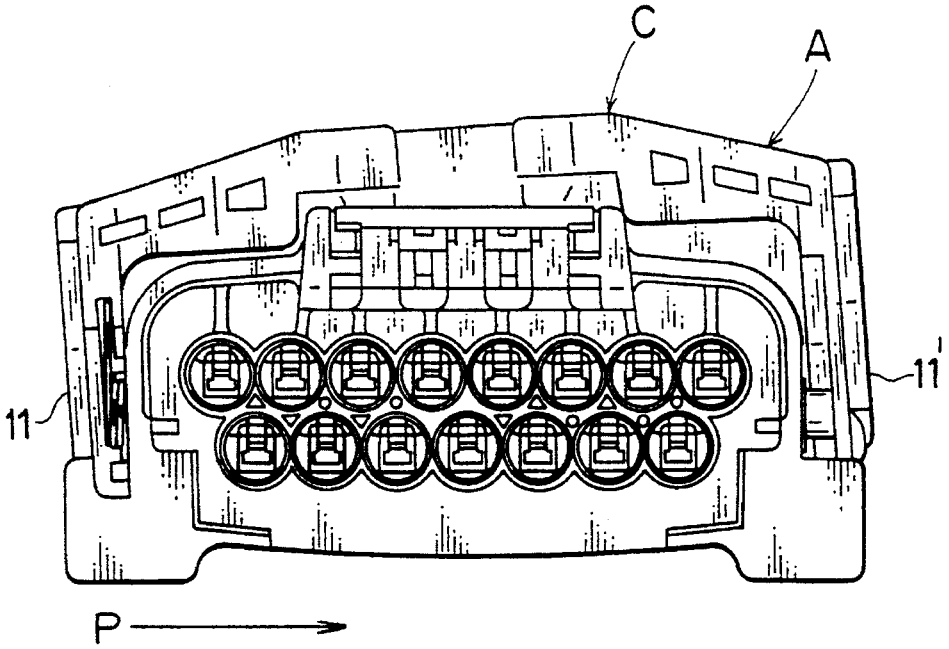
FIG. 7 is a rear elevation showing a state that one of the side arms has been mounted to the connector housing in the embodiment.
Figure 8:
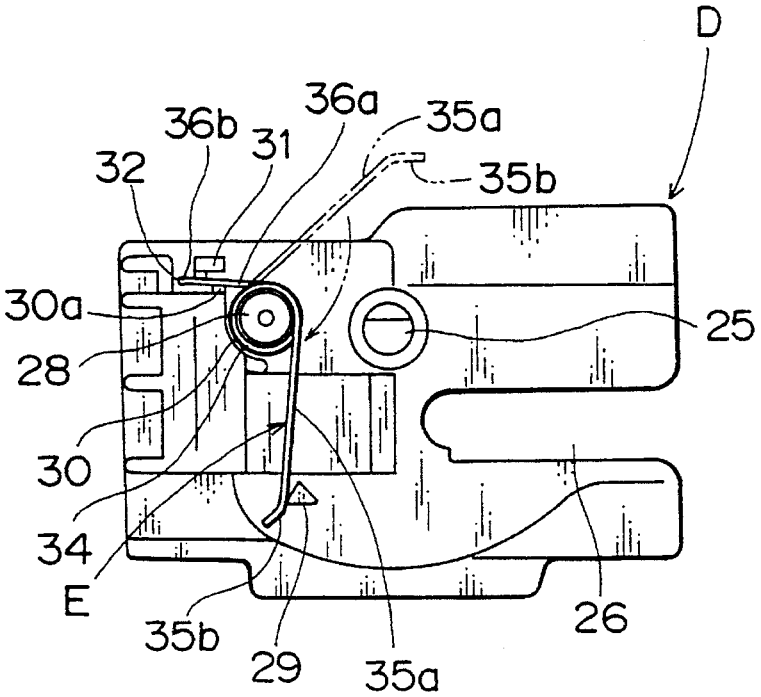
FIG. 8 PRIOR ART
FIG. 8 is a side view of a connector-coupling-lever mounting assembly in a prior art.
Figure 9:
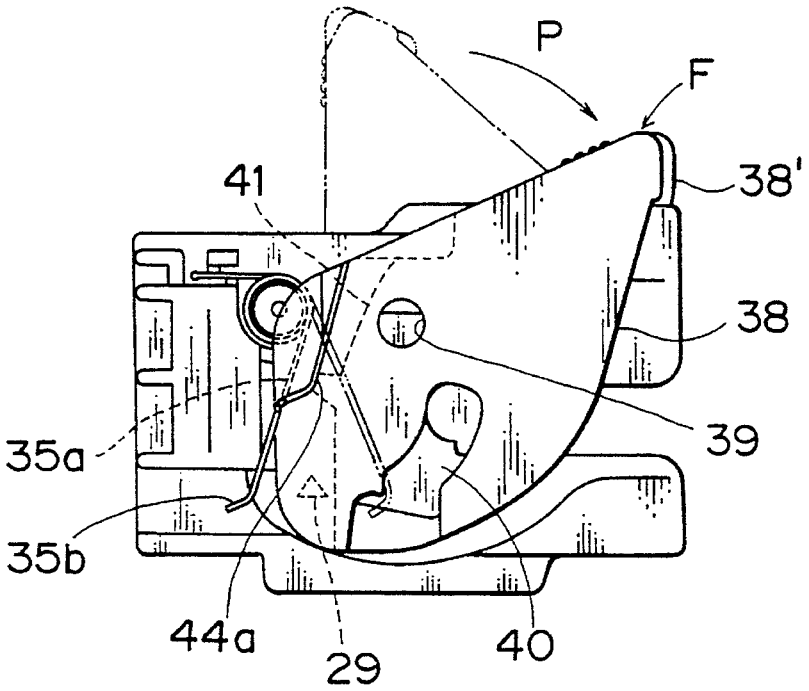
FIG. 9 PRIOR ART
FIG. 9 is a side view showing steps of mounting the coupling lever to the connector housing in the prior art.
Figure 10:
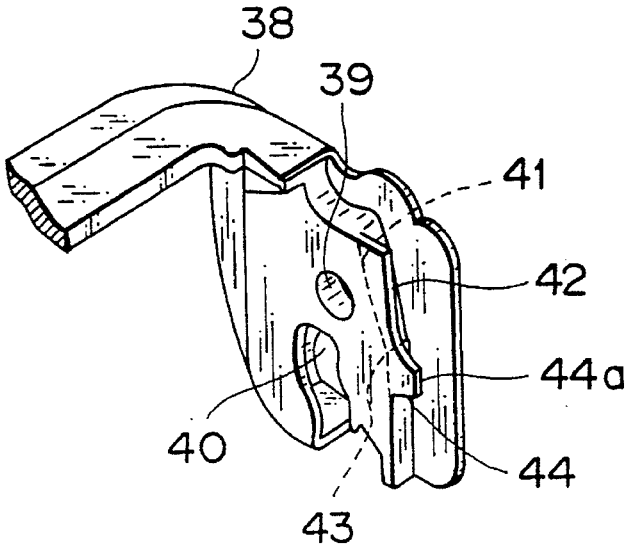
FIG. 10 PRIOR ART
FIG. 10 is a perspective view of the primary parts of the coupling lever in the prior art.

Then, as shown in FIG. 7, the shaft bearing hole 12 formed in the other side arm 11 engages with the corresponding supporting shaft 1, which completes the mounting of the coupling lever C to the housing A. And, the coupling lever, as shown FIG. 1, has turned forward by the resilient force of the spring.

The effects made by the present invention will be described in the followings.

In the present invention, the free end of the spring is provisionally locked to the provisionally locking channel formed so as to be apart from the housing side wall. Thereby, when the coupling lever is mounted to the supporting shaft of the housing side wall, the free end of the spring is released from the provisionally locking channel. Therefore, the free end of the spring can be easily received in the coupling lever by the resiliency of the spring without turning the coupling lever as the prior art. As a result, it accomplishes a reduction in work to mount the coupling lever to the connector housing and a reduction in the mounting time. Moreover, it makes the mounting work easy.

What is claimed is:

1. A connector-coupling-lever mounting method, comprising the steps of:

engaging the windings of a spring with a supporting shaft extending outwardly from a side wail of a connector housing, and fixing a first end of said spring to a locking portion of said side wall;

engaging a second end of said spring, remote from said first end, with a provisional locking channel by way of an insertion channel, wherein both said insertion channel elongated along said side wall of said connector housing and said provisional locking channel extending in an outward direction from said side wall are provided in a provisional locking portion attached to said connector housing;

engaging a beating hole formed in a side arm of said connector-coupling lever with said supporting shaft; and pushing said second end of said spring toward said side wall by a side arm of a connector-coupling lever so that a resilient force of said spring can release said second end of said spring from said provisional locking channel so as to fit said second end in a spring-end receiving portion formed in said side arm of said lever.

2. A connector-coupling-lever mounting method as claimed in claim 1, further comprising the steps of:

engaging said side arm having said spring-end receiving portion of said connector-coupling lever with said side wall having said provisional locking portion of said connecter housing, and then, engaging another side arm, opposite of said side arm, of said connector-coupling lever with another side wall, opposite of said side wall, of said connector housing.

3. A connector-coupling-lever mounting assembly, comprising:

a connector-coupling lever having a side arm;

a connector housing having a side wall and a supporting shaft extending outwardly from said side wall, said supporting shaft being engageable with a bearing hole formed in a side arm of said connector-coupling lever;

a spring for providing a resilient force acting on said connector-coupling lever, said spring having windings engageable with said supporting shaft, and having a first end and a second end remote from said first end;

a locking portion provided on said side wall of said connector housing for fixing said first end of said spring;

a lever-engagement guiding portion provided on an outer surface of said side wall of said connector housing; and a provisional locking portion provided on said lever-engagement guiding portion for provisionally engaging said second end of said spring, said provisional locking portion having an insertion channel elongated along said side wall of said connector housing and a provisional locking channel elongated from said insertion channel in an outward direction from said side wall to form a hooking portion.

4. A connector-coupling-lever mounting assembly as claimed in claim 3, further comprising an engagement channel formed in said side arm of said connector-coupling lever for receiving said second end of said spring.

5. A connector-coupling-lever mounting assembly as claimed in claim 4, wherein another side wall, opposite of said side wall; of said connector housing has a supporting shaft extending outwardly from said another side wall, said supporting shaft being engageable with a bearing hole formed in another side arm, opposite said side arm, of the connector-coupling lever and wherein each of said bearing holes of said side arms is engageable with said corresponding supporting shaft by outward bending of said side arms.

6. A connector-coupling-lever mounting assembly as claimed in claim 5, wherein both said connector housing and said connector-coupling lever are made of synthetic resin.

* * * * *